US006733235B2

(12) United States Patent
Alford et al.

(10) Patent No.: US 6,733,235 B2
(45) Date of Patent: May 11, 2004

(54) SHROUD SEGMENT AND ASSEMBLY FOR A TURBINE ENGINE

(75) Inventors: Mary Ellen Alford, Cincinnati, OH (US); Mark Eugene Noe, Morrow, OH (US); Toby George Darkins, Jr., Loveland, OH (US); Madeleine Elise Fessler, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 146 days.

(21) Appl. No.: 10/109,014

(22) Filed: Mar. 28, 2002

(65) Prior Publication Data

US 2003/0185674 A1 Oct. 2, 2003

(51) Int. Cl.[7] ..... F01D 11/08

(52) U.S. Cl. ..... 415/173.1; 415/174.4; 415/213.1; 416/191

(58) Field of Search ..... 415/173.1, 173.4, 415/174.4, 213.1; 416/191, 200

(56) References Cited

U.S. PATENT DOCUMENTS 3,085,398 A * 4/1963 Ingleson ..... 415/127
3,854,843 A * 12/1974 Penny ..... 415/197
4,050,843 A * 9/1977 Needham et al. ..... 415/116
5,071,313 A 12/1991 Nichols ..... 415/134
5,074,748 A 12/1991 Hagle ..... 415/170.1
5,127,793 A 7/1992 Walker et al. ..... 415/115
5,228,828 A * 7/1993 Damlis et al. ..... 415/173.2
5,480,281 A * 1/1996 Correia ..... 415/115
5,562,408 A 10/1996 Proctor et al. ..... 415/173.1

* cited by examiner

*Primary Examiner*—Edward K. Look
*Assistant Examiner*—Igor Kershteyn
(74) *Attorney, Agent, or Firm*—David L. Narciso; Lee H. Sachs

(57) ABSTRACT

A turbine engine shroud segment comprises a body including a radially outer surface having axially and circumferentially spaced apart edge surfaces. The segment includes a projection integral with and projecting generally radially outwardly from the body, and positioned at a generally midway surface portion between the axially spaced apart edge surfaces. The projection comprises a head and a transition portion with a cross section smaller than that of the head and integral with and between the head and the body. In a turbine engine shroud assembly, a plurality of such shroud segments are assembled circumferentially with a shroud hanger carrying the projection in a hanger cavity through end portions of radially inner opposed hook members that register with the projection at the transition portion.

16 Claims, 4 Drawing Sheets

SHROUD SEGMENT AND ASSEMBLY FOR A TURBINE ENGINE

The Government may have certain rights in this invention pursuant to Contract No. F33615-97-C-2778 awarded by the Department of Air Force.

BACKGROUND OF THE INVENTION

This invention relates generally to turbine engine shroud segments and shroud segment assemblies including a surface exposed to elevated temperature engine gas flow. More particularly, it relates to air cooled gas turbine engine shroud segments, for example used in the turbine section of a gas turbine engine, and made of a low ductility material.

A plurality of gas turbine engine stationary shroud segments assembled circumferentially about an axial flow engine axis and radially outwardly about rotating blading members, for example about turbine blades, defines a part of the radial outer flowpath boundary over the blades. As has been described in various forms in the gas turbine engine art, it is desirable to maintain the operating clearance between the tips of the rotating blades and the cooperating, juxtaposed surface of the stationary shroud segments as close as possible to enhance engine operating efficiency. Typical examples of U.S. patents relating to turbine engine shrouds and such shroud clearance include U.S. Pat. No. 5,071,313—Nichols; U.S. Pat. No. 5,074,748—Hagle; U.S. Pat. No. 5,127,793—Walker et al.; and U.S. Pat. No. 5,562,408—Proctor et al.

In its function as a flowpath component, the shroud segment and assembly must be capable of meeting the design life requirements selected for use in a designed engine operating temperature and pressure environment. To enable current materials to operate effectively as a shroud in the strenuous temperature and pressure conditions as exist in the turbine section flowpath of modern gas turbine engines, it has been a practice to provide cooling air to a radially outer portion of the shroud. Examples of typical cooling arrangements are described in some of the above identified patents.

The radially inner or flow path surfaces of shroud segments in a gas turbine engine shroud assembly about radially inward rotating blades are arced circumferentially to define a flowpath annular surface about the rotating tips of the blades. Such annular surface is the sealing surface for the turbine blade tips. Since the shroud is a primary element in a turbine blade clearance control system, minimizing shroud deflection and maintaining shroud radially inner surface arc or "roundness" during operation of a gas turbine engine assists in minimizing performance penalty to an engine cycle. Several operating conditions tend to distort such roundness.

One condition is the application of cooling air to the radially outer portion of a shroud segment, creating in the shroud segment a thermal gradient or differential between the radially inner shroud surface exposed to a relatively high operating gas flow temperature and the cooled radially outer surface. One result of such thermal gradient is a form of shroud segment deformation or deflection generally referred to as "chording". At least the radially inner or flowpath surface of a shroud and its segments are arced circumferentially to define a flowpath annular surface about the rotating tips of the blades. The thermal gradient between the inner and outer faces of the shroud, resulting from cooling air impingement on the outer surface, causes the arc of the shroud segments to chord or tend to straighten out circumferentially. As a result of chording, the circumferential end portions of the inner surface of the shroud segment tend to move radially outwardly in respect to the middle portion of the segment.

In addition to thermal distorting forces generated by such thermal gradient are distorting fluid pressure forces, acting on the shroud segment. Such forces result from a fluid pressure differential between the higher pressure cooling air on the shroud segment radial outer surface and the axially decreasing lower pressure engine flowstream on the shroud radially inner surface. With the cooling air maintained at a substantially constant pressure on the shroud radially outer surface during engine operation, such fluid pressure differential on a shroud segment increases axially downstream through the engine in a turbine section as the turbine extracts power from the gas stream. This action reduces the flow stream pressure progressively downstream. Such pressure differential tends to force the axial end portions, more so the axially aft or downstream portion, of a shroud segment radially inwardly. Therefore, a complex array of forces and pressures act to distort and apply pressures to a turbine engine shroud segment during engine operation to change the roundness of the arced shroud segment assembly radially inner surface. It is desirable in the design of such a turbine engine shroud and shroud assembly to compensate for such forces and pressures acting to deflect or distort the shroud segment.

Metallic type materials currently and typically used as shrouds and shroud segments have mechanical properties including strength and ductility sufficiently high to enable the shrouds to be restrained against such deflection or distortion resulting from thermal gradients and pressure differential forces. Examples of such restraint include the well known side rail type of structure, or the C-clip type of sealing structure, for example described in the above identified Walker et al patent. That kind of restraint and sealing results in application of a compressive force at least to one end of the shroud to inhibit chording or other distortion.

Current gas turbine engine development has suggested, for use in higher temperature applications such as shroud segments and other components, certain materials having a higher temperature capability than the metallic type materials currently in use. However such materials, forms of which are referred to commercially as a ceramic matrix composite (CMC), have mechanical properties that must be considered during design and application of an article such as a shroud segment. For example, as discussed below, CMC type materials have relatively low tensile ductility or low strain to failure when compared with metallic materials. Also, CMC type materials have a coefficient of thermal expansion (CTE) in the range of about 1.5–5 microinch/inch/° F., significantly different from commercial metal alloys used as restraining supports or hangers for metallic shrouds and desired to be used with CMC materials. Such metal alloys typically have a CTE in the range of about 7–10 microinch/inch/° F. Therefore, if a CMC type cooled on one surface during operation, forces can be developed in CMC type segment sufficient to cause failure of the segment.

Generally, commercially available CMC materials include a ceramic type fiber for example SiC, forms of which are coated with a compliant material such as BN. The fibers are carried in a ceramic type matrix, one form of which is SiC. Typically, CMC type materials have a room temperature tensile ductility of no greater than about 1%, herein used to define and mean a low tensile ductility material. Generally CMC type materials have a room temperature tensile ductility in the range of about 0.4–0.7%. This is compared with metallic shroud and/or supporting structure or hanger materials having a room temperature tensile ductility of at least about 5%, for example in the range of about 5–15%. Shroud segments made from CMC type materials, although having certain higher temperature capabilities than those of a metallic type material, cannot tolerate the above described and currently used type of compressive force or similar restraint force against chording and other deflection or distortion. Neither can they withstand a stress rising type of feature, for example one provided at a relatively small bent or filleted surface area, without sustaining damage or fracture typically experienced by ceramic type materials. Furthermore, manufacture of articles from CMC materials limits the bending of the SiC fibers about such a relatively tight fillet to avoid fracture of the relatively brittle ceramic type fibers in the ceramic matrix. Provision of a shroud segment of such a low ductility material, particularly in combination or assembly with a shroud support or hanger that carries the segment without application of excessive pressure to the segment, with appropriate surfaces for sealing of edge portions from leakage thereabout, would enable advantageous use of the higher temperature capability of CMC material for that purpose.

BRIEF SUMMARY OF THE INVENTION

Forms of the present invention provide a turbine engine shroud segment, for example for mounting in a shroud assembly with a shroud hanger and a method for making such a shroud. The shroud segment comprises a shroud segment body and a shroud segment projection integral with and projecting generally radially outwardly from the shroud body. The shroud segment body includes a radially inner surface; a radially outer surface; a first plurality, in one example a pair, of spaced apart axial edge surfaces connected with and between each of the inner and outer surfaces; and a second plurality, in one example a pair, of spaced apart circumferential edge surfaces connected with and between each of the inner and outer surfaces.

The shroud segment includes a shroud segment projection integral with and extending generally radially outwardly from the shroud body radially outer surface. The projection is positioned on the body radially outer surface spaced apart in a generally midway surface portion between second plurality of spaced apart circumferential edge surfaces. In one embodiment of the shroud segment in which the projection extends generally between circumferential edge surfaces, the projection is located at a position between axial edge surfaces on the body radially outer surface as a function of the fluid pressure differential experienced by the shroud segment during operation. Such location is generally at a pressure differential midpoint or balancing position between the axially forward and aft edge surfaces of the segment to reduce, and preferably substantially eliminate, during engine operation, force differences on the projection carrying the segment body. Because the pressure differential between cooling air and engine flowstream increases during operation from axially forward to aft on the segment, as power is extracted from the flowstream through a gas turbine, the projection generally is positioned niore toward the axially aft portion of the segment.

The projection comprises a projection head spaced apart from the body radially outer surface, and a projection transition portion, having a transition surface, integral with both the projection head and the midway portion of the body radially outer surface. The projection transition portion between the projection head and the body radial outer surface is smaller in cross section than the projection head, at least in one of the axial and circumferential directions. For use with a low ductility material, for example a CMC, the transition surface is arcuate to avoid a stress riser type condition in the transition portion. One embodiment of the projection integral with the body sometimes is referred to as a "dovetail" shape.

Another form of the present invention is a turbine engine shroud assembly comprising a plurality of the above described shroud segments, assembled circumferentially to define a segmented turbine engine shroud, and a shroud hanger carrying the shroud segments. The shroud hanger comprises a hanger radially inner surface defining a hanger cavity terminating in at least one pair of spaced apart hanger radially inner hook members opposed one to the other, each hook member including an end portion, for example as spaced apart hanger radially inner hook portions. Each end portion includes an end portion inner surface defining a portion of the hanger cavity radially inner surface and is shaped to cooperate in registry with and carry the shroud segment projection at the shroud segment projection transition surface. In one embodiment, the shroud hanger includes a shroud segment positioning member for positioning the shroud segment in at least one of the circumferential, radial and axial directions. For example, such a member is a radially inwardly positioned and preloaded pin, received at or in a recess in the projection head, applying generally radially inward pressure to the projection head sufficient to press the projection transition surfaces toward and in contact with the hanger end portion inner surfaces.

DETAILED DESCRIPTION OF THE INVENTION

The present invention will be described in connection with an axial flow gas turbine engine for example of the general type shown and described in the above identified Proctor et al patent. Such an engine comprises, in serial flow communication generally from forward to aft, one or more compressors, a combustion section, and one or more turbine sections disposed axisymmetrically about a longitudinal engine axis. Accordingly, as used herein, phrases using the term "axially", for example "axially forward" and "axially aft", are directions of relative positions in respect to the engine axis; phrases using forms of the term "circumferential" refer to circumferential disposition generally about the engine axis; and phrases using forms of the term "radial", for example "radially inner" and "radially outer", refer to relative radial disposition generally from the engine axis.

Figure 1:
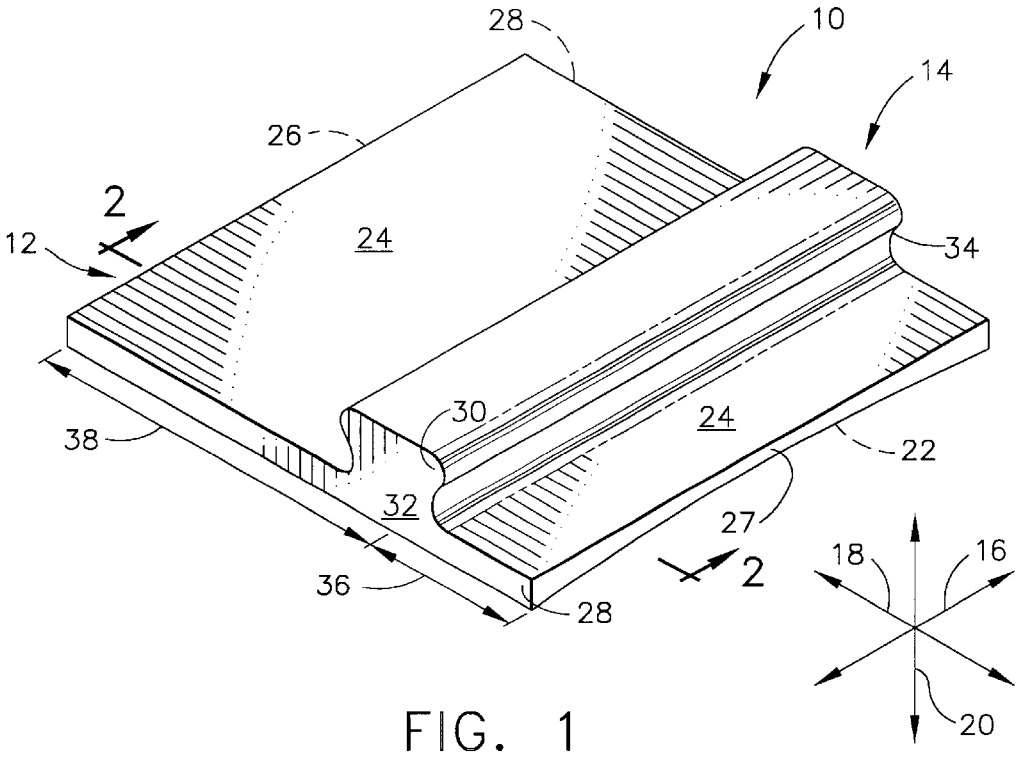
FIG. 1 is a perspective diagrammatic view of one embodiment of a shroud segment including a projection from a shroud body radially outer surface.

The perspective, diagrammatic view of FIG. 1 shows a shroud segment shown generally at 10, including a shroud body 12 and a shroud segment projection shown generally at 14. In FIG. 1, projection 14 is shown in a shape sometimes referred to in the turbine art as a dovetail shape. Orientation of shroud segment 10 in a turbine engine, in the embodiment of FIG. 1, is shown by arrows 16, 18, and 20 representing, respectively, the engine circumferential, axial, and radial directions.

Shroud segment body 12 includes a radially inner surface 22, shown to be arcuate in the circumferential direction 16; a radially outer surface 24; a first plurality of spaced apart axial edge surfaces including axially forward edge surface 26 and axially aft edge surface 27; and a second plurality of spaced apart circumferential edge surfaces 28. The axial and circumferential edge surfaces shown in the embodiment of FIG. 1 to be pairs of surfaces, are connected with and between shroud segment body radially inner surface 22 and radially outer surface 24 to define, therebetween, shroud segment body 12. Shroud segment projection 14 is integral with and extends generally radially outwardly from shroud segment body radially outer surface 24. Projection 14 comprises a projection head 30, spaced apart from shroud body radially outer surface 24, and a projection transition portion or neck 32 having a transition surface 34. Transition portion 32, integral with both shroud segment body radially outer surface 24 and projection head 30, has a cross section smaller than the cross section of projection head 30, as shown in the drawing.

Figure 5:
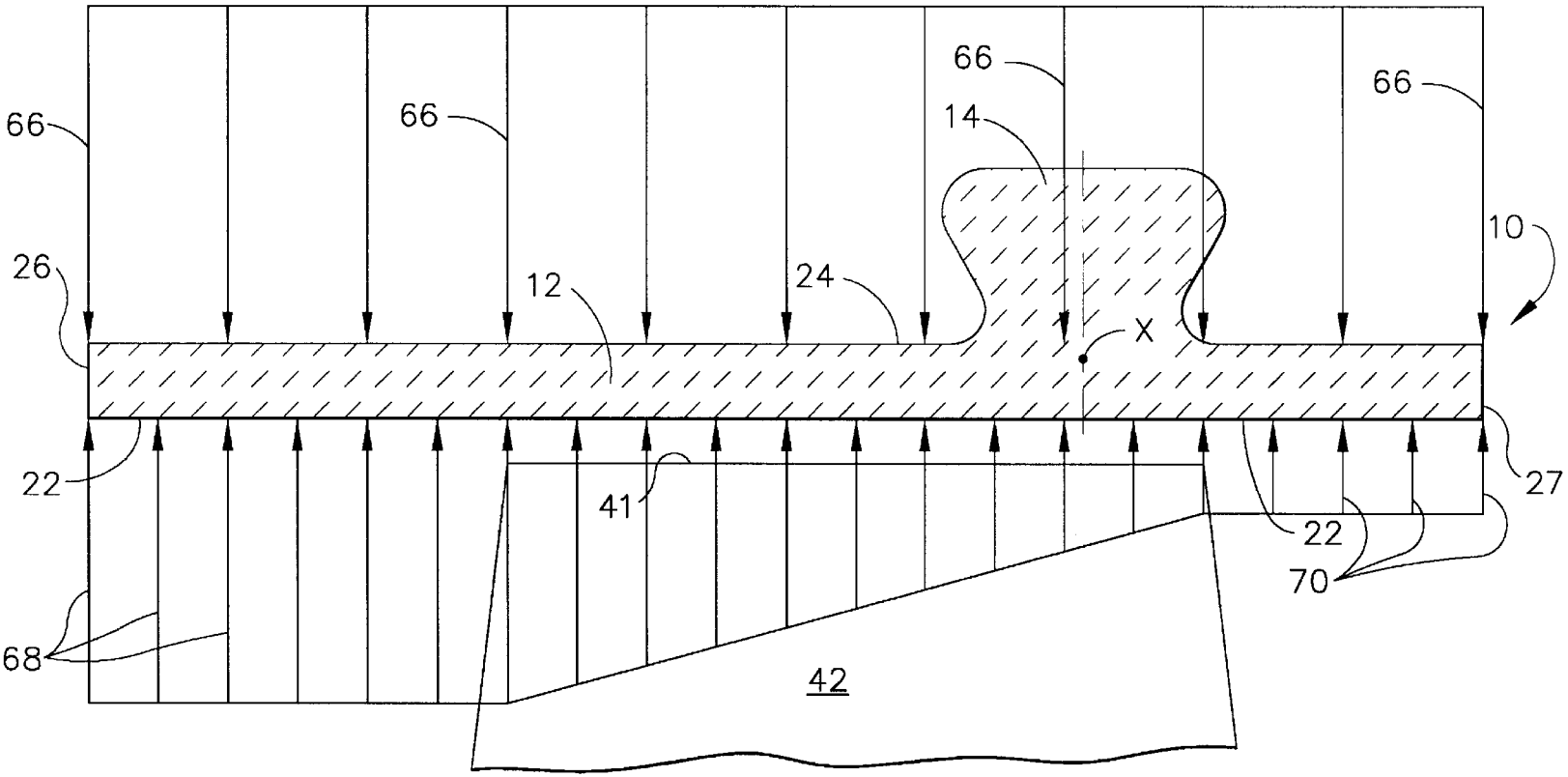
FIG. 5 is a diagrammatic view of one example of the relative positioning of a shroud projection on the radially outer surface of a shroud segment of CMC material as a function of the relative fluid pressures acting on the segment during engine operation.

In the embodiment of FIG. 1, projection 14 extends between circumferential edge surfaces 28 and is spaced apart from axial edge surfaces 26 and 27, generally on a mid-portion of the shroud segment body radially outer surface 24. Projection 14 is positioned axially closer to axially aft edge surface 27, represented by a distance 36, than it is to axially forward edge surface 26, represented by a distance 38 that is greater than distance 36. Such relative position of projection 14 between the axially forward and aft edge surfaces, closer to the axially aft portion of shroud 10, is selected as a function of the above discussed fluid pressure differential experienced by the shroud segment during engine operation. Such "off-center" type of positioning reduces and preferably balances forces acting on projection 14 carrying shroud body 12 during engine operation. Such forces result from the variable pressure differential across shroud segment 10 during engine operation, increasing in the engine axial aft direction 18 as turbine flowstream pressure decreases downstream through the turbine, for example as shown in FIG. 5. Such a reduction or balancing of forces on the shroud segment projection is particularly important in an embodiment in which the shroud segment is made of a low ductility material: detrimental potential damaging forces on the projection carrying the shroud body are at least reduced.

Figure 2:
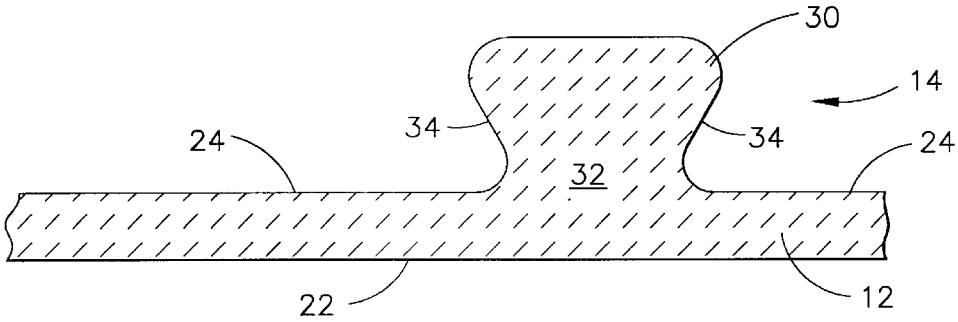
FIG. 2 is an enlarged, fragmentary sectional view taken along lines 2—2 of the shroud segment of FIG. 1.
Figure 3:
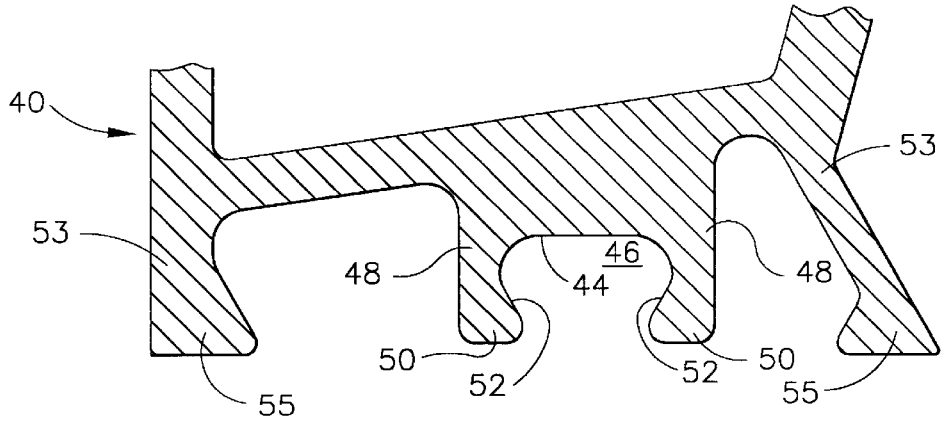
FIG. 3 is a fragmentary, sectional diagrammatic view in a gas turbine engine circumferential direction of one embodiment of a shroud segment hanger shaped to cooperate with and carry the shroud segment of FIG. 1 in a turbine engine shroud assembly.

FIG. 2 is an enlarged, fragmentary sectional view of a portion of shroud segment 10, taken in circumferential direction 16 along lines 2—2 of FIG. 1. FIG. 2 shows more clearly and in detail that embodiment of the members and surfaces of shroud segment 10 in the general vicinity of projection 14. In FIG. 2, a portion of projection transition surface 34 intended to register with a shroud hanger, such as shown in FIG. 3, preferably is a planar surface for ease of matching in shape with a cooperating hanger surface. Such planar cooperating surfaces particularly are preferred to reduce undesirable forces on transition surface 34 when the shroud segment is made of a CMC material.

FIG. 3 is a fragmentary sectional, diagrammatic view of one general embodiment of a shroud segment hanger, shown generally as 40. Shroud segment hanger 40 comprises a hanger radially inner surface 44 defining a hanger cavity 46, hanger 40 at hanger cavity 46 including at least one pair of spaced apart radially inner hook members 48, generally axially opposed one to the other and terminating in a hook end portion 50. Each end portion 50 includes an end portion inner surface 52. Inner surface 52 preferably is matched in shape with at least a cooperating portion of transition surface 34, preferably planar to more easily match with planar transition surface 34 of projection neck 32 as shown in FIG. 2. Accordingly, inner surface 52 defines a portion of hanger cavity 46 and is shaped to cooperate in registry with and carry shroud segment projection 14 in FIG. 1 at shroud segment projection transition surface 34. Shroud hanger 40, in the embodiment of FIG. 3, includes axially spaced apart first and second shroud segment stabilizing arms 53, including stabilizing arm end portions 55, disposed radially inwardly.

Figure 4:
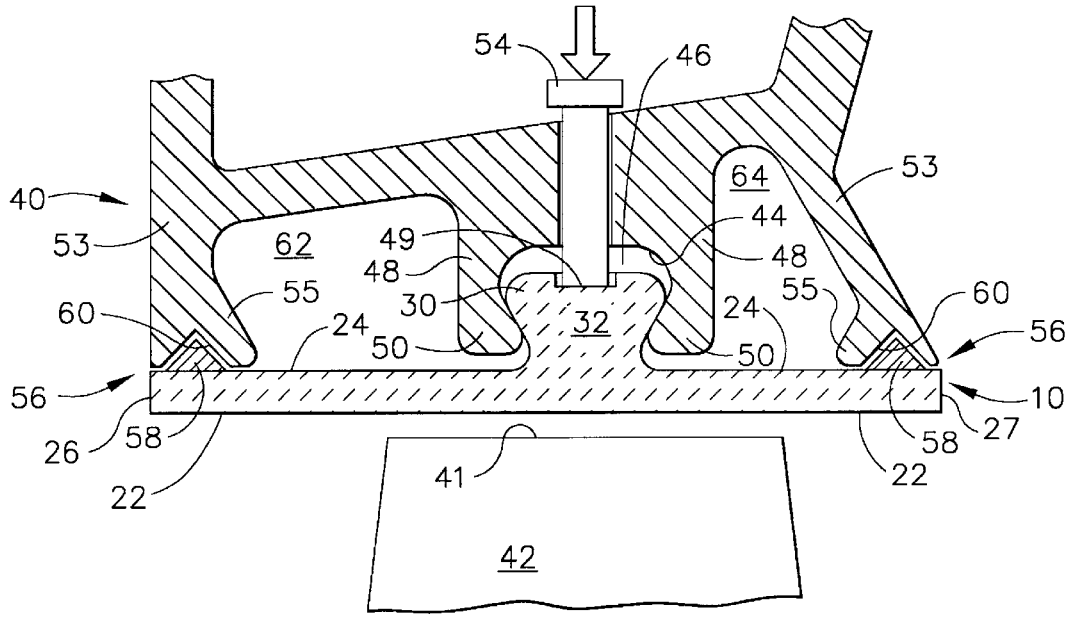
FIG. 4 is a fragmentary, diagrammatic, partially sectional view of an embodiment of an assembly of the shroud segment, generally as shown in FIG. 1, with the shroud segment hanger portion of FIG. 3, carrying the shroud segment in juxtaposition with a rotating turbine blade of a gas turbine engine.
Figure 6:
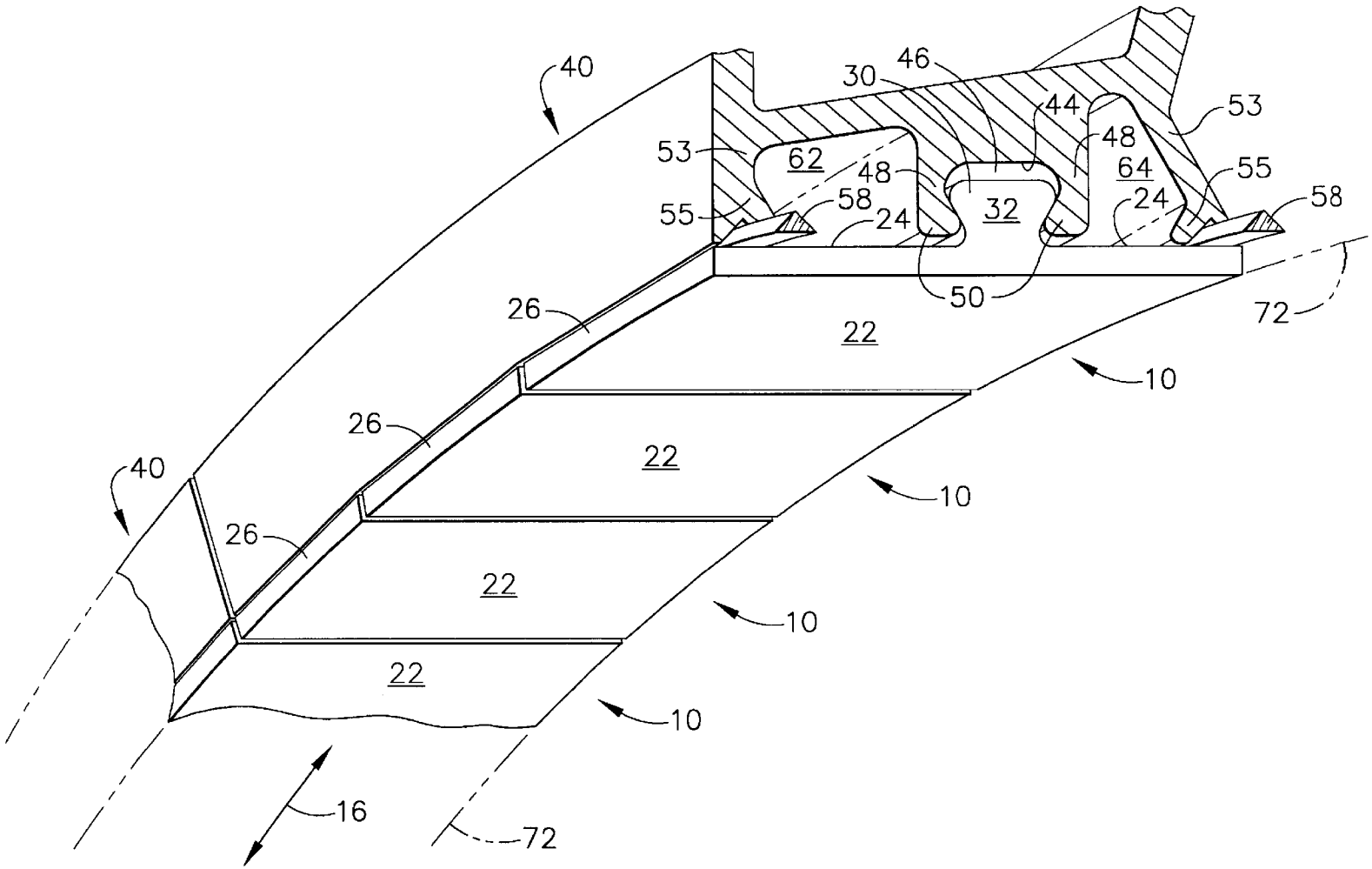
FIG. 6 is a diagrammatic, fragmentary, perspective, partially sectional view of a plurality of the shroud segments and shroud segment hangers shown in FIGS. 1–4 assembled circumferentially to define a segmented turbine engine shroud assembly.

FIG. 4 is a fragmentary, diagrammatic, partially sectional view, in circumferential direction 16, of the shroud segment of FIG. 1 in assembly in a gas turbine engine with a more detailed embodiment of shroud hanger 40 of FIG. 3. In such an assembly, shroud segment 10 is one of a plurality of circumferentially disposed, adjacent shroud segments disposed in the turbine section of the engine. One embodiment of the assembly is shown in the diagranimatic fragmentary, perspective, partially sectional view of FIG. 6 in which 72 represents the circumferential turbine engine shroud assembly. In such assembly, shroud segment 10 is carried at projection 14 by stationary shroud hanger shown generally at 40 at its end portion inner surface 52 cooperating with projection transition portion surface 34. Shroud body radially inner surface 22 thus is disposed in juxtaposition with tip 41 a rotating turbine blade 42, generally as shown in the above-identified Proctor et al. patent. As was discussed above, shroud segment 10 is carried by shroud segment hanger 40 through shroud segment projection 14 at a position more closely to axially aft shroud segment surface 27 than to axially forward shroud segment surface 26. This positioning reduces forces acting on shroud segment projection 14 during engine operation.

In the more detailed view of the assembly of FIG. 4, shroud hanger 40 includes a shroud segment positioning member 54, shown in the form of a pin associated with hanger 40. In the embodiment of FIG. 4, positioning member 54 extends through hanger 40, registering with projection head 30 to maintain the position of shroud segment 10 at least one of circumferentially, axially and radially. In that specific example, member registers with head 30 in a recess 49 in head 30 to maintain the position of shroud segment 10 in all three directions. As shown, member 54 is preloaded radially inwardly to apply radially inward pressure to projection head 30 sufficient to press projection transition portion surfaces 34 toward and in contact with hanger end portion surfaces 52. Further in that embodiment, the assembly of shroud segment 10 with shroud hanger 40 includes, at a radially inner portion of each stabilizing arm 53 disposed in respect to the shroud segment body radially outer surface at the shroud body axially forward and aft surfaces 26 and 27, respectively, axially forward and aft seals shown generally at 56 between hanger 40 and shroud segment 10. Such seals are shown in FIG. 4 in the form of bar seals 58, for example of a type shown in the above identified Walker et al. patent, cooperating in recesses 60 in end portions 55 of hanger arms 53 in juxtaposition with shroud segment body radially outer surface 24. The seals reduce leakage of cooling fluid or air applied to the radially outer surface of shroud segment 10. Typically in the gas turbine engine art, such cooling air is applied through a passage (not shown) into hanger cavities 62 and 64 at a pressure greater than the pressure of the engine flowstream adjacent shroud segment radially inner surface 22.

The diagrammatic view of FIG. 5 represents one example of the relative positioning of projection 14 of shroud segment 10 on a generally midway portion of radially outer surface 24 of shroud body 12. Projection 14 is positioned as a function of and to substantially compensate for the fluid pressure differential and forces acting on shroud 10 in a gas turbine engine turbine section during one typical type of engine operation. The material of construction of shroud segment 10 selected for the example of FIG. 5 was the above-identified SiC fiber SiC matrix CMC material.

As shown diagrammatically in FIG. 5, in this example the pressure of the cooling air across shroud body radially outer surface 24, represented by arrows 66, was at a constant pressure, P1. However, in the turbine flowpath operating in this example on shroud body radially inner surface, the pressure of the gas stream applied to shroud body radially inner surface 22 varied from an upstream pressure P2, represented by arrows 68 and less than P1, to a downstream pressure P3, represented by arrows 70, about one third to one fourth the upstream pressure of P2. The relative length of other arrows in FIG. 5 in the gas stream adjacent shroud body radially inner surface 22 intervening between arrows 68 and 70 represent, diagrammatically, a progressive decrease in pressure downstream through the turbine past turbine blade 42. Shown in the example of FIG. 5, and based on such pressure differentials, projection 14 was positioned closer to axially aft edge surface 27 of shroud body 12.

According to an embodiment of the present invention in which the shroud segment was made of the CMC material, projection 14 of shroud segment 10 was disposed at a position "X" on radially outer surface 24, representing the substantial radial centerline of projection 14. Such position was selected closer to radially aft edge 27 as a function of, to compensate for, and to reduce or balance differences in forces acting during engine operation on projection 14 to avoid cracking of projection 14. In this example as shown in FIG. 5, the position "X" on shroud segment body 12 was in the range of about two thirds to three fourths of the distance from axially forward edge 26 to axially aft edge 27.

Although the present invention has been described in connection with specific embodiments, materials and combinations of structures, it should be understood that they are intended to be typical of rather than in any way limiting on the scope of the present invention. Those skilled in the several arts involved, such as relating to turbine engines, to metallic, non-metallic and composite materials, and their combinations, will understand that the invention is capable of variations and modifications without departing from the scope of the appended claims.

What is claimed is:

1. A turbine engine shroud segment comprising a shroud segment body including a radially inner surface arcuate at least circumferentially, a radially outer surface, a first plurality of spaced apart axial edge surfaces connected with and between each of the inner and outer surfaces, and a second plurality of spaced apart circumferential edge surfaces connected with and between each of the inner and outer surfaces, wherein:

the shroud segment includes a single shroud segment projection, for carrying the shroud segment body, integral with and projecting generally radially outwardly from the shroud segment body radially outer surface;

the projection being positioned on the shroud segment body radially outer surface at a generally midway surface portion spaced apart from the first plurality of axial edge surfaces and extending generally between the second plurality of circumferential edge surfaces;

the projection comprising a projection head spaced apart from the shroud body radially outer surface, and a projection transition portion having a transition surface, the projection transition portion being integral with both the projection head and the shroud body radially outer surface, the transition portion being smaller in cross section than the projection head in at least one of the axial and circumferential directions;

the shroud segment being made of a low ductility material having a low tensile ductility, measured at room temperature to be no greater than about 1%; and, the projection transition portion being arcuate.

2. The shroud segment of claim 1 in which the transition surface includes a planar portion.

3. The shroud segment of claim 1 in which the projection is at a position at the generally midway surface portion closer to an axially aft of the first plurality of edge surfaces.

4. The shroud segment of claim 3 in which the position of the projection closer to the axially aft of the first plurality of edge surfaces is selected based on and substantially to reduce in the axial direction forces generated on the projection during operation of the turbine.

5. The shroud segment of claim 4 in which the position is selected substantially to balance in the axial direction forces generated on the projection during operation of the turbine.

6. The shroud segment of claim 4 in which:

the shroud segment is made of a ceramic matrix composite material having a tensile ductility measured at room temperature of no greater than about 1%; and, the projection transition portion is arcuate.

7. A method for making a turbine engine shroud segment comprising a shroud segment body including a radially inner surface arcuate at least circumferentially, a radially outer surface, a first plurality of spaced apart axial edge surfaces connected with and between each of the inner and outer surfaces, and a second plurality of spaced apart circumferential edge surfaces connected with and between each of the inner and outer surfaces, the shroud segment including a shroud segment projection, for carrying the shroud segment body, integral with and projecting generally radially outwardly from the shroud segment body radially outer surface;

the projection being positioned on the shroud segment body radially outer surface at a generally midway surface portion between at least one of the first and second plurality of edge surfaces;

the projection comprising a projection head spaced apart from the shroud body radially outer surface, and a projection transition portion having a transition surface, the projection transition portion being integral with both the projection head and the shroud body radially outer surface, the transition portion being smaller in cross section than the projection head in at least one of the axial and circumferential directions comprising the steps of:

determining operating forces acting during engine operation on the shroud segment body as a result of a combination of temperature differential and pressure differential between an air cooled radially outer surface and the radially inner surface exposed to a flowstream of the turbine engine; and, selecting the position of the projection on the midway surface portion substantially to reduce the operating forces acting on the projection carrying the shroud segment body.

8. The method of claim 7 in which:

the shroud segment includes a single projection; and, the single projection is selected to be at the generally midway surface portion of the shroud body radially outer surface spaced apart from the first plurality of axial edge surfaces and extends generally between the second plurality of circumferential edge surfaces.

9. The method of claim 8 in which the projection is at a position at the generally midway surface portion closer to an axially aft of the first plurality of edge surfaces.

10. The method of claim 9 in which:

a low ductility material having a low tensile ductility, measured at room temperature to be no greater than about 1% is selected for the shroud segment; and, the projection transition portion is arcuate.

11. The method of claim 9 in which the position of the projection closer to the axially aft of the first plurality of edge surfaces is selected based on and substantially to reduce in the axial direction forces generated on the projection during operation of the turbine.

12. A turbine engine shroud assembly comprising:

a plurality of the turbine engine shroud segments of claim 4 assembled circumferentially to define a segmented turbine engine shroud; and, a shroud hanger carrying the shroud segments at each shroud segment projection;

the shroud hanger comprising a hanger radially inner surface defining a hanger cavity terminating in at least one pair of spaced apart radially inner hook members opposed one to the other;

each hook member including an end portion having an end portion inner surface defining a portion of the hanger cavity radially inner surface and shaped to cooperate in registry with and carry the shroud segment projection at the shroud segment projection transition surface;

the shroud hanger including a shroud segment positioning member in contact with the shroud segment for positioning the shroud segment in at least one of the circumferential, radial and axial directions.

13. The shroud assembly of claim 12 in which the end portion inner surface of each hook member includes a planar portion to register with a planar portion of shroud segment projection transition surface.

14. The shroud assembly of claim 12 in which the shroud segment positioning member is a pin through the shroud hanger preloaded toward the shroud segment.

15. The shroud assembly of claim 12 in which:

the shroud hanger includes axially spaced apart shroud segment stabilizing arms, each including a stabilizing arm end portion disposed toward and in juxtaposition with the shroud segment body radially outer surface generally at the spaced apart shroud body axial edge surfaces; and, a fluid seal is disposed between and in contact with each stabilizing arm end portion and the shroud segment body radially outer surface.

16. The shroud assembly of claim 14 in which the shroud projection head includes a recess and the pin is disposed in the recess in contact with projection head.

* * * * *